US011346640B2

(12) United States Patent
Huang

(10) Patent No.: US 11,346,640 B2
(45) **Date of Patent: *May 31, 2022**

(54) TWO-STAGE PROPULSION SYSTEM

(71) Applicant: Jian-Lin Huang, Tainan (TW)

(72) Inventor: Jian-Lin Huang, Tainan (TW)

( * ) Notice: Subject to any disclaimer, the term of this patent is extended or adjusted under 35 U.S.C. 154(b) by 0 days.

This patent is subject to a terminal disclaimer.

(21) Appl. No.: 16/990,065

(22) Filed: Aug. 11, 2020

(65) Prior Publication Data

US 2022/0049935 A1 Feb. 17, 2022

(51) Int. Cl.

| | |
|---|---|
| ***F42B 15/10*** | (2006.01) |
| ***F42B 15/00*** | (2006.01) |
| ***F42B 3/16*** | (2006.01) |
| *A62C 19/00* | (2006.01) |
| *F41F 3/045* | (2006.01) |

(52) U.S. Cl.

CPC ..... *F42B 3/16* (2013.01); *F42B 15/00* (2013.01); *F42B 15/10* (2013.01); *A62C 19/00* (2013.01); *F41F 3/045* (2013.01)

(58) Field of Classification Search

CPC .. F42C 19/02; F42C 19/0807; F42C 19/0819; F42B 5/16; F42B 8/24; F42B 15/00; F42B 3/16; F42B 15/10; F02K 9/28; F02K 9/30; F02K 9/36; F02K 9/76; F02K 9/763

See application file for complete search history.

(56) References Cited

U.S. PATENT DOCUMENTS

| | | | | | |
|---|---|---|---|---|---|
| 2,442,528 | A * | 6/1948 | Beattle | F42B 12/68 | 102/340 |
| 2,500,117 | A * | 3/1950 | Chandler | F42B 10/30 | 60/201 |
| 2,856,851 | A * | 10/1958 | Thomas | F42B 15/36 | 102/374 |
| 2,968,245 | A * | 1/1961 | Sutton | F42B 10/30 | 244/3.23 |
| 3,008,414 | A * | 11/1961 | Jasse | F42C 19/0807 | 102/372 |
| 3,292,302 | A * | 12/1966 | Estes | A63H 27/005 | 446/212 |
| 3,388,666 | A * | 6/1968 | Walther | F42B 5/105 | 102/377 |
| 3,721,193 | A * | 3/1973 | Piester | F02K 9/763 | 102/352 |
| 3,886,841 | A * | 6/1975 | Smith | F42B 5/105 | 89/1.3 |
| 3,922,967 | A * | 12/1975 | Mertens | F42C 15/22 | 102/439 |
| 4,355,577 | A * | 10/1982 | Ady | C06B 31/08 | 102/287 |

(Continued)

OTHER PUBLICATIONS

Easy PVC Rockets. Jason Smiley. <http://ftp.demec.ufpr.br/foguete/bibliografia/Easy%20PVC%20Rockets-Book.pdf>. 2005. (Year: 2005).*

(Continued)

*Primary Examiner* — Gabriel J. Klein

(74) *Attorney, Agent, or Firm* — Rosenberg, Klein & Lee

(57) ABSTRACT

The present disclosure provides a propulsion system with a retardant set between two sections of propellant for delaying the combustion and reducing the generated smoke or heat while launching the propulsion system.

20 Claims, 7 Drawing Sheets

(56) References Cited

U.S. PATENT DOCUMENTS 5,160,070 A * 11/1992 Hibler ..... F02K 9/28
60/250
9,021,957 B1 * 5/2015 Farina ..... F42B 15/10
102/376
9,664,142 B1 * 5/2017 Huang ..... F02K 9/28

OTHER PUBLICATIONS

Optimal Staging Delay. The Rocketry Forum. <https://www.rocketryforum.com/threads/optimal-staging-delay.20286/>. Mar. 2011. (Year: 2011).*
Sorbitol & Potassium Nitrate Rocket Propellant. <https://web.archive.org/web/20180918000731/http://www.doranaerospace.com/Sorbitol.html>. Sep. 18, 2018. (Year: 2018).*

* cited by examiner

TWO-STAGE PROPULSION SYSTEM

TECHNICAL FIELD

The present disclosure relates to a system for propulsion, especially, a propulsion system using solid fuel.

DISCUSSION OF THE BACKGROUND

As the solid fuel becomes popular and safer, it also changes types of the propulsion system not only for military but also for people's livelihood.

For example, a fire-extinguishing rocket system can be used to handle blazes far away from an operator. The system, which may have a rocket launcher, can fire a rocket filled with a fire-extinguishing agent to hit the fire source dozens of floors up. The rocket is capable of going through the window and spreading the fire-extinguishing agent inside a house. Therefore, the operator can put out the fire without getting into the house. As another example, a throwing gun may also have a rocket launcher as the propulsion system to make a rope reach a far place. However, while the propulsion system is launched, lots of smoke and heat may be produced and emitted, and it may harm people who stand nearby. Therefore, an invention for the propulsion system to avoid such risk is required.

SUMMARY

One aspect of the present disclosure provides a propulsion system, comprising: a first section comprising a first chamber containing a first propellant; a second section that is connected to the first section and comprises a second chamber containing a second propellant; and a retardant set between the first propellant and the second propellant for delaying the combustion from the first propellant to the second propellant.

By delaying the combustion from the first propellant to the second propellant, the propellant will not be burned at once, and the emitted smoke and heat can be decreased. Thus, people who stand nearby will be safe.

The foregoing has outlined rather broadly the features and technical advantages of the present disclosure in order that the detailed description of the disclosure that follows may be better understood. Additional features and advantages of the disclosure will be described hereinafter, and form the subject of the claims of the disclosure. It should be appreciated by those skilled in the art that the conception and specific embodiment disclosed may be readily utilized as a basis for modifying or designing other structures or processes for carrying out the same purposes of the present disclosure. It should also be realized by those skilled in the art that such equivalent constructions do not depart from the spirit and scope of the disclosure as set forth in the appended claims.

BRIEF DESCRIPTION OF THE DRAWINGS

A more complete understanding of the present disclosure may be derived by referring to the detailed description and claims when considered in connection with the Figures, where like reference numbers refer to similar elements throughout the Figures, and:

DETAILED DESCRIPTION

Figure 1B:
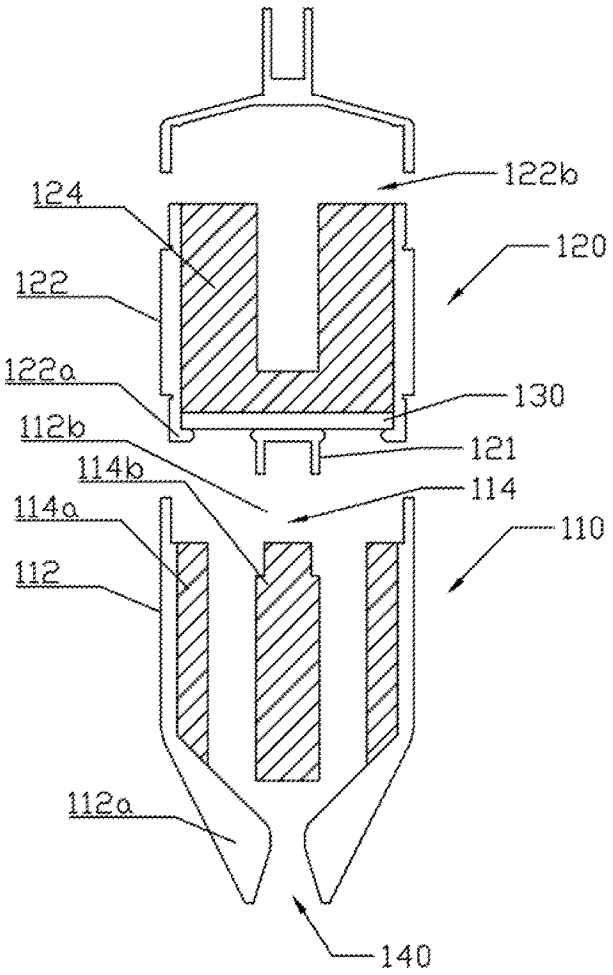
FIG. 1A is a side view and FIG. 1B is a cross-sectional view showing a propulsion system in accordance with an embodiment of the present disclosure.

Embodiments, or examples, of the disclosure illustrated in the drawings are now described using specific language. It shall be understood that no limitation of the scope of the disclosure is hereby intended. Any alteration or modification of the described embodiments, and any further applications of principles described in this document, are to be considered as normally occurring to one of ordinary skill in the art to which the disclosure relates. Reference numerals may be repeated throughout the embodiments, but this does not necessarily mean that feature(s) of one embodiment apply to another embodiment, even if they share the same reference numeral.

It shall be understood that, although the terms first, second, third, etc. may be used herein to describe various elements, components, regions, layers or sections, these elements, components, regions, layers or sections are not limited by these terms. Rather, these terms are merely used to distinguish one element, component, region, layer or section from another region, layer or section. Thus, a first element, component, region, layer or section discussed below could be termed a second element, component, region, layer or section without departing from the teachings of the present inventive concept.

The terminology used herein is for the purpose of describing particular example embodiments only and is not intended to be limited to the present inventive concept. As used herein, the singular forms "a," "an" and "the" are intended to include the plural forms as well, unless the context clearly indicates otherwise. It shall be further understood that the terms "comprises" and "comprising," when used in this specification, point out the presence of stated features, integers, steps, operations, elements, or components, but do not preclude the presence or addition of one or more other features, integers, steps, operations, elements, components, or groups thereof.

Figure 1A:
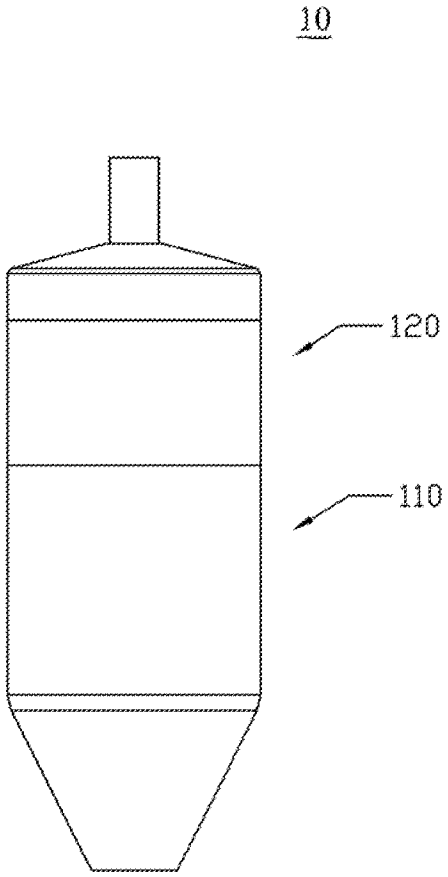

FIG. 1A is a side view and FIG. 1B is a cross-sectional view showing a propulsion system 10 in accordance with an embodiment of the present disclosure. By referring to FIGS.

1A and 1B, the propulsion system 10 comprises a first section 110, a second section 120, and a retardant set 130. Each of the first section 110, the second section 120, and the retardant set 130 may contain propellants, and the heat fluxes eject from a chamber bottom 112*a* of the first section 110.

FIG. 1B is a cross-sectional view showing a propulsion system 10 disassembled into the first section 110, the second section 120, and the retardant set 130 in accordance with the embodiment of the present disclosure. The first section 110 may comprise a first chamber 112 containing a first propellant 114, which may comprise propellant elements 114*a* and 114*b*. The second section 120 is connected to the first section 110 and comprises a second chamber 122 containing a second propellant 124. The retardant set 130 is positioned between the first propellant 114 and the second propellant 124 for delaying the combustion from the first propellant 114 to the second propellant 124.

Figure 2B:
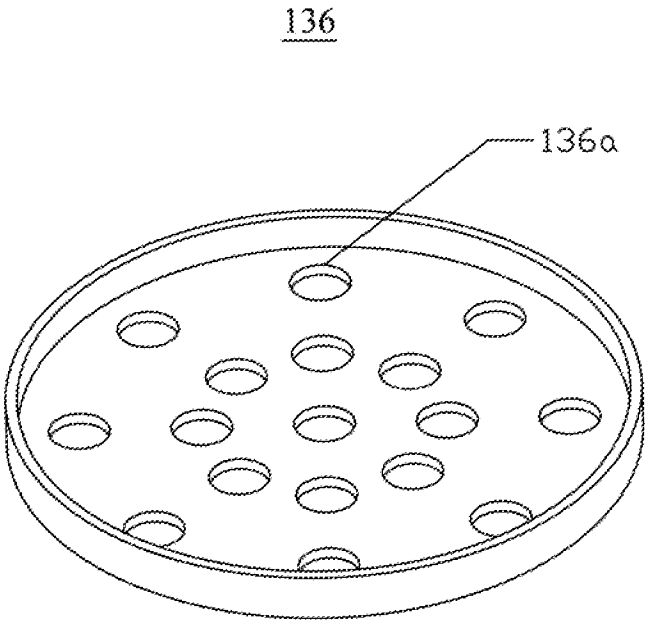
FIG. 2B is a perspective view showing the dish with holes in its bottom in accordance with yet another embodiment of the present disclosure.
Figure 2A:
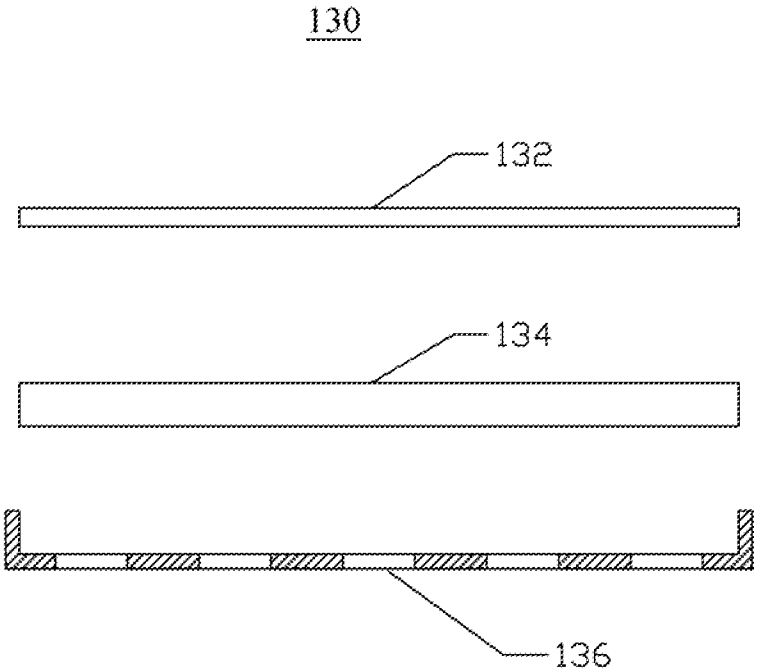
FIG. 2A is a cross-sectional view showing a retardant set comprising a dish, a third propellant, and a mesh in accordance with another embodiment of the present disclosure.

FIG. 2A is a cross-sectional view showing the retardant set 130 disassembled into a dish 136, a third propellant 134, and a mesh 132 in accordance with another embodiment of the present disclosure. FIG. 2B is a perspective view showing the dish 136 with holes 136*a* in its bottom in accordance with yet another embodiment of the present disclosure. By referring to FIG. 2A, the third propellant 134 may be contained by the dish 136, and may be covered by the mesh 132. Optionally, the third propellant 134 may comprise Sorbitol, Potassium Nitrate, and Iron Oxide. Alternatively, the third propellant 134 may be the solid fuel with a low regression rate. For example, the third propellant 130 may comprise Sorbitol, Potassium Nitrate, and Sodium Bicarbonate. Moreover, the Sodium Bicarbonate to the Sorbitol and the Potassium Nitrate may be about 15 to 100 in weight, and a ratio of Sorbitol to Potassium Nitrate is about 35 to 65 in weight.

Figure 3:
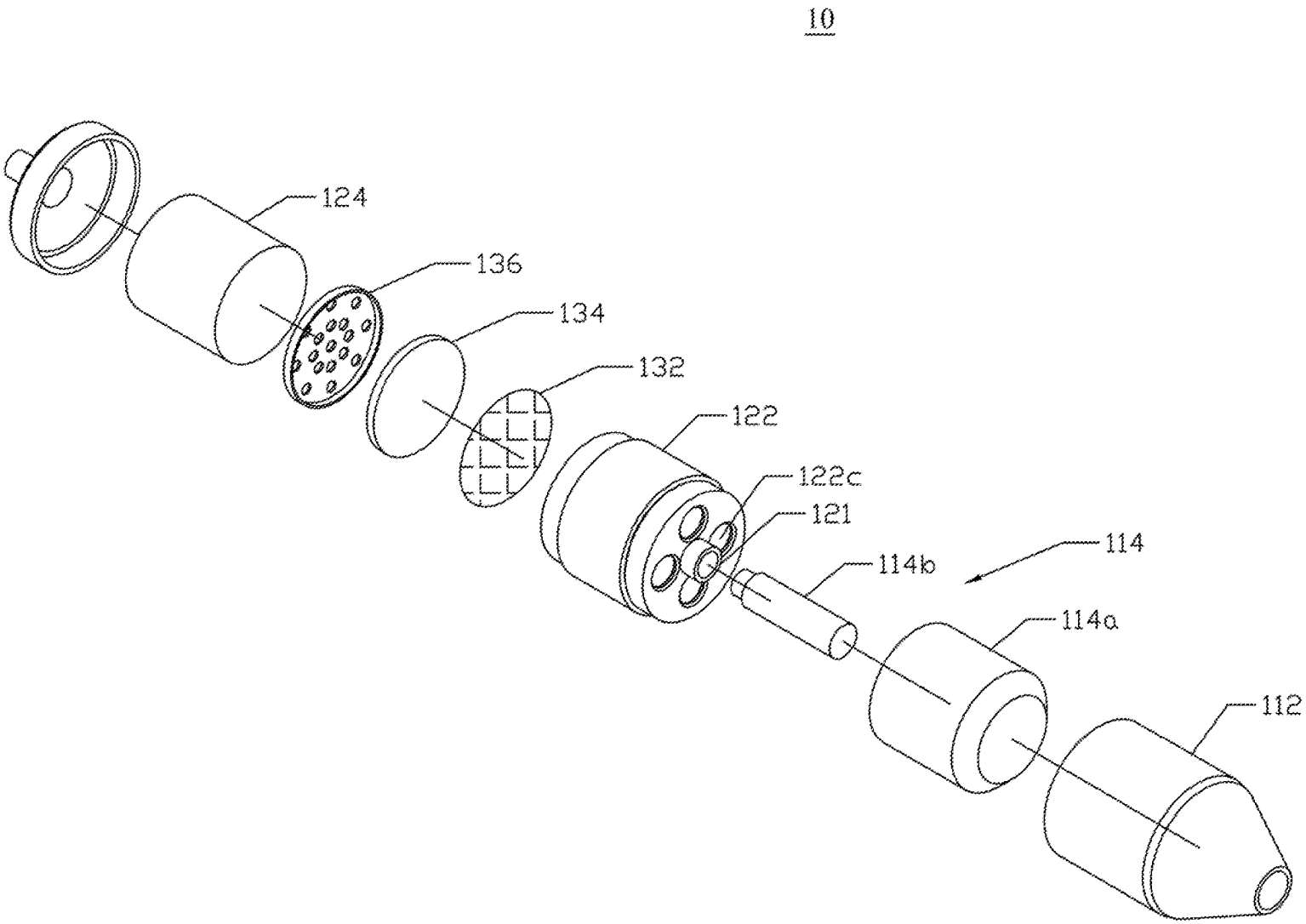
FIG. 3 is an exploded view of the propulsion system in accordance with yet another embodiment of the present disclosure.

FIG. 3 is an exploded view of the propulsion system 10 in accordance with yet another embodiment of the present disclosure. By referring to FIGS. 2A and 3, the retardant set 130 faces to the first propellant 114 by the mesh 132, and the retardant set 130 faces to the second propellant 124 by the dish 136.

Figure 4:
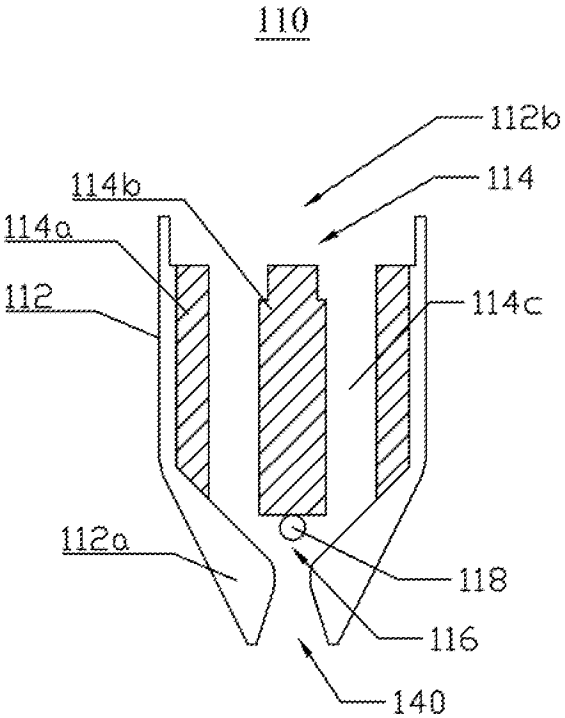
FIG. 4 is a cross-sectional view showing the first section in accordance with a further embodiment of the present disclosure.

FIG. 4 is a cross-sectional view showing the first section 110 in accordance with a further embodiment of the present disclosure. The first section 110 may comprise an igniter 118, the first propellant 114 may comprise one or more combustion channels 114*c*. Optionally, the first chamber 112 may comprise an open top 112*b* and a bottom 112*a* with one or more holes. Optionally, the first propellant 114 comprises Sorbitol, Potassium Nitrate, and Iron Oxide, and a ratio of Sorbitol to Potassium Nitrate of the first propellant 114 is about 35 to 65 in weight.

Optionally, the first section 110 may further comprise a nozzle 140 in the bottom 112*a* of the first section 110. Optionally, a space 116 may be formed between the nozzle 140 and the first propellant 114 as a buffer for heat fluxes.

Figure 5:
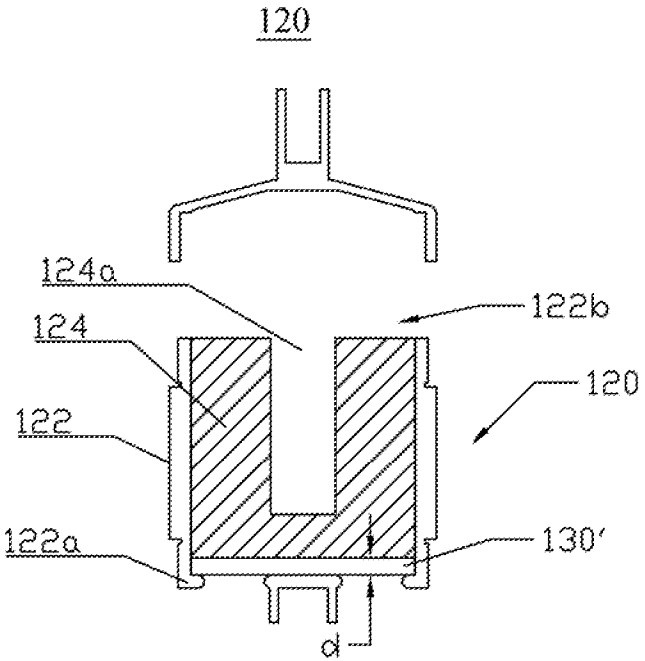
FIG. 5 is a cross-sectional view showing the second section in accordance with a further embodiment of the present disclosure.

FIG. 5 is a cross-sectional view showing the second section 120 in accordance with a further embodiment of the present disclosure. The second propellant 124 may comprise one or more combustion channels 124*a*. Also referring to FIG. 3, the second chamber 122 may comprise a bottom 122*a* with one or more holes 122*c* to allow the combustion passing the bottom 122*a* of the second chamber 122, and the bottom 122*a* of the second chamber 122 may comprise a mounting base 121 for fixing the propellant element 114*b* of the first section 110. By referring to FIGS. 4 and 5, the second chamber 122 may be connected to the open top 112*b* of the first chamber 112 by the bottom 122*a* of the second chamber 122. The second chamber 122 may also have a top 122*b* opposite to the bottom 122*a*.

While the propulsion system is launched and a person may be stand near the propulsion system or inside a house, the amount of the emitted smoke and heat is required to be decreased to prevent the person from being harmed, the retardant set 130 may be installed between the first propellant 114 and the second propellant 124 to keep the combustion from the first propellant 114 to the second propellant 124, however, with the decreased smoke or heat. For example, by referring to FIG. 5, the retardant set 130 shown in FIG. 2A may be installed in the space 130' over the bottom 122*a* of the second chamber 122.

Optionally, the thickness d of the space 130' for containing the retardant set 130 may be about 1 centimeter by way of example but not limitation. Optionally, the second propellant 124 comprises Sorbitol, Potassium Nitrate, and Iron Oxide, and a ratio of Sorbitol to Potassium Nitrate of the second propellant 124 is about 35 to 65 in weight.

By referring to FIGS. 4 and 5, the combustion channels 114*c* form an exposed surface of the first propellant 114, and the combustion channels 124*a* form an exposed surface of the second propellant 124. Optionally, to increase the lifting power while launching the propulsion system 10, the exposed surface of the first propellant 114 may be more than an exposed surface of the second propellant 124.

Figure 6B:
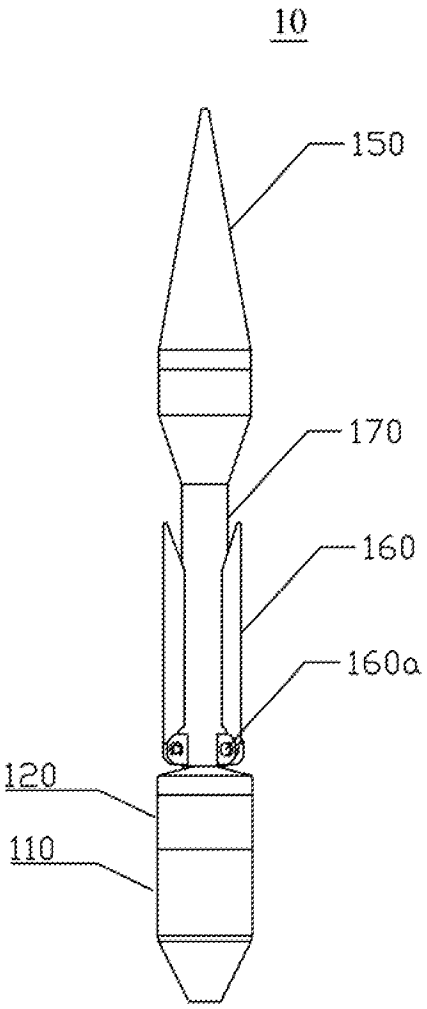
FIG. 6B is a side view showing a propulsion system with folded wings in accordance with other embodiments of the present disclosure.
Figure 6A:
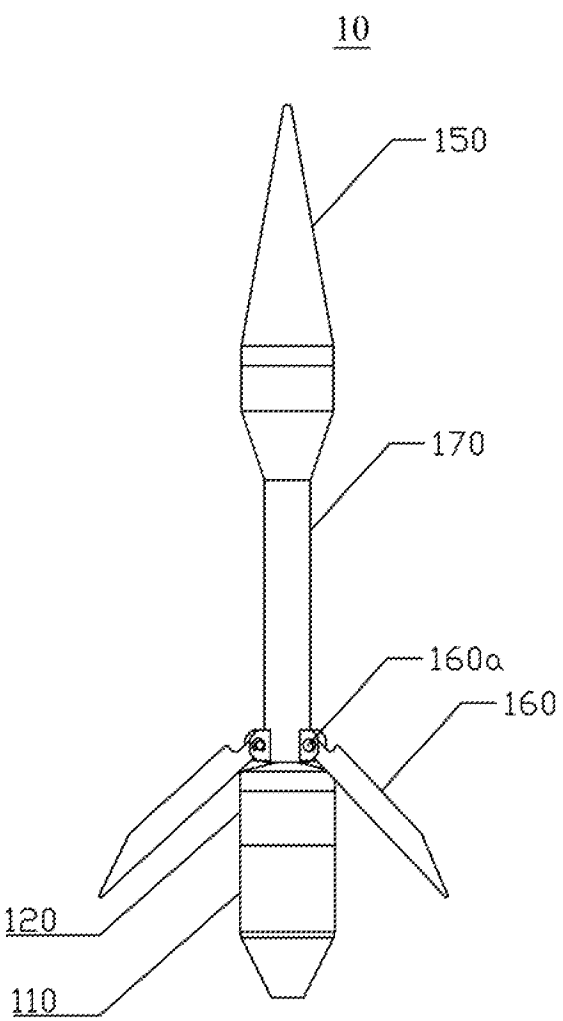
FIG. 6A is a side view showing a propulsion system with unfolded wings.

FIG. 6A is a side view showing a propulsion system 10 with unfolded wings 160 and FIG. 6B is a side view showing a propulsion system 10 with folded wings 160 in accordance with other embodiments of the present disclosure. By referring to FIGS. 6A and 6B, the propulsion system 10 may further comprise a warhead 150 on the body section 170 over the second section 120. Optionally, the propulsion system 10 may further comprise wings 160, which can be folded or unfolded by the axes 160*a*. Therefore, the propulsion system 10 can be put into a launch tube when the wings 160 are folded in FIG. 6B, and have a stable flying path when the wings 160 are unfolded in FIG. 6A.

Figure 7:
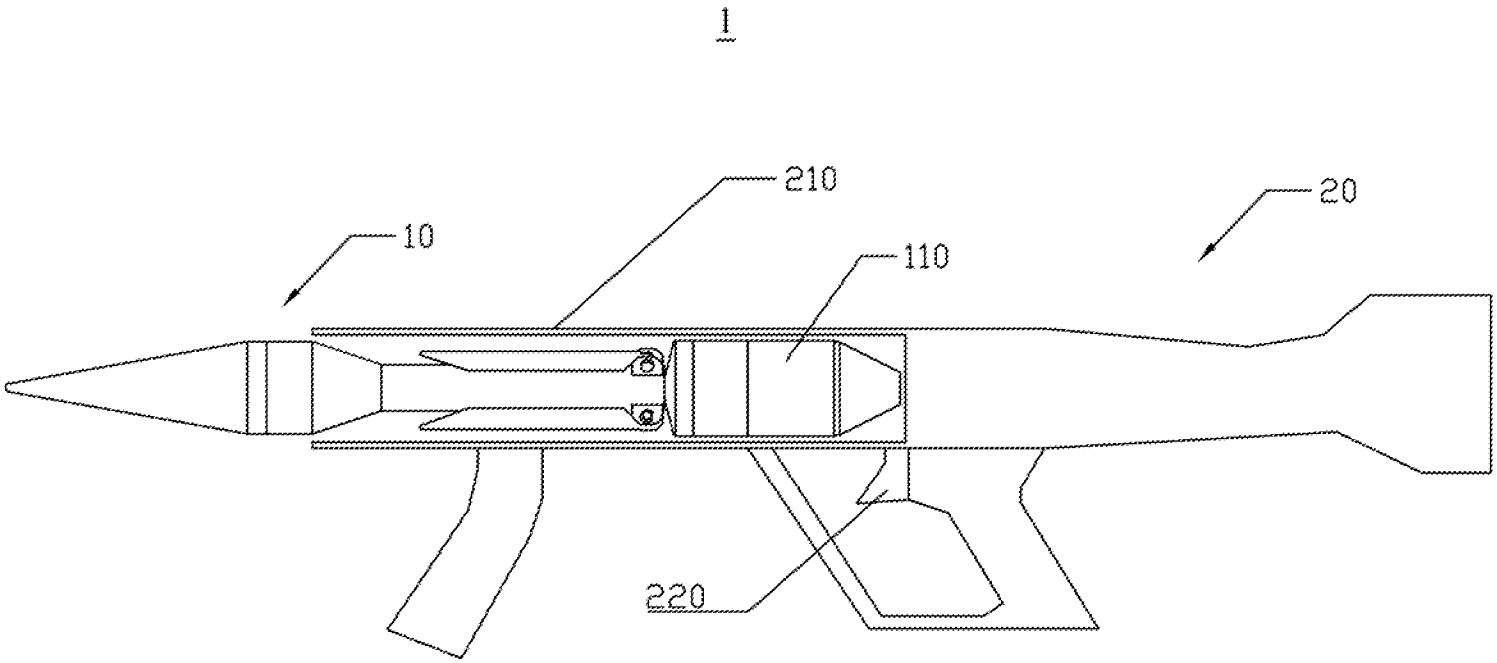
FIG. 7 is a cross-sectional view showing a throwing device in accordance with an embodiment of the present disclosure.

FIG. 7 is a cross-sectional view showing a throwing device 1 in accordance with an embodiment of the present disclosure. The throwing device 1 may comprise a propulsion system 10 and a launcher 20. The launcher 20 may comprise a trigger 220 and a tube 210 for containing the propulsion system 10.

Figure 8:
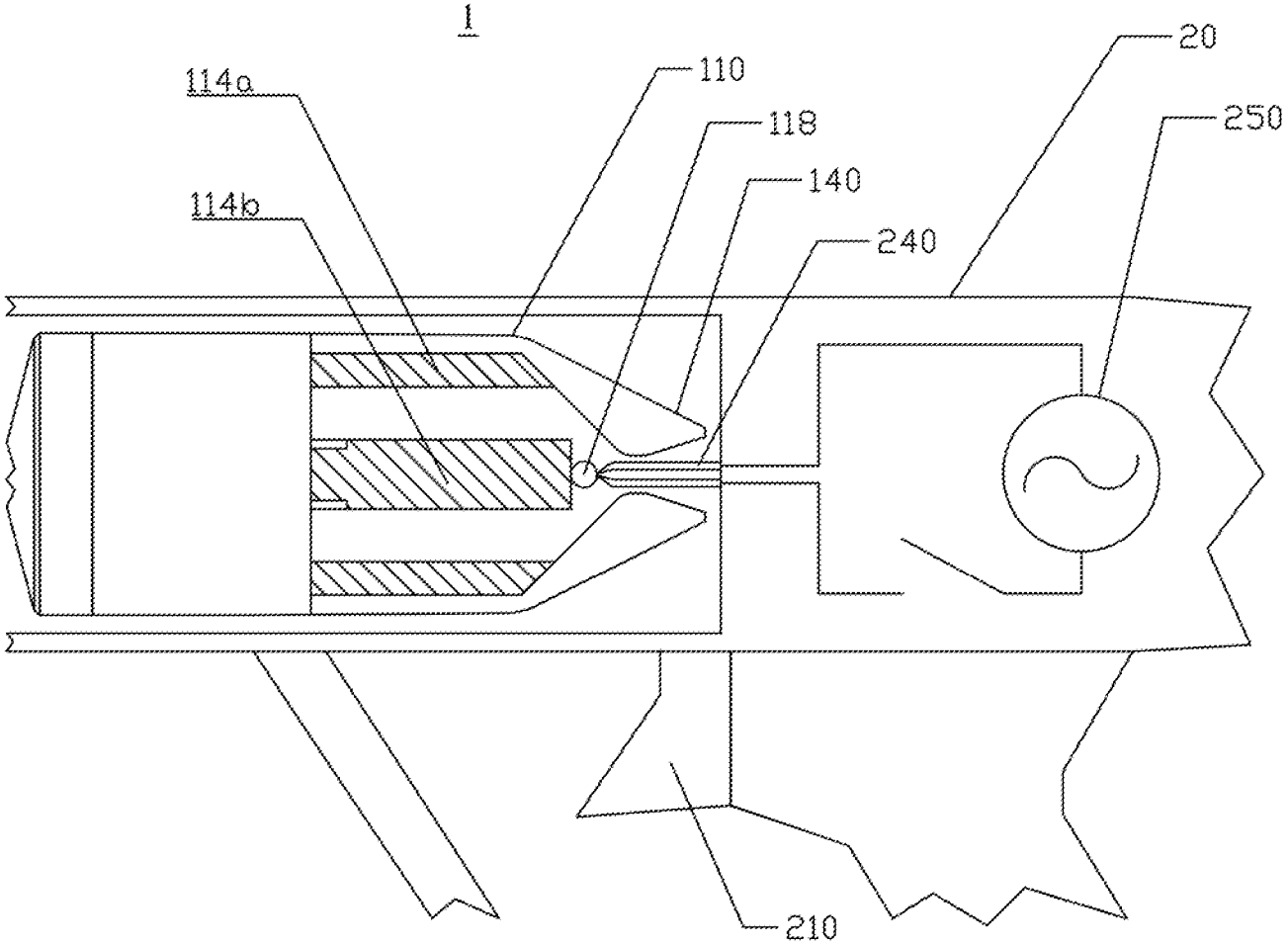
FIG. 8 is a cross-sectional view showing a part of the throwing device shown in FIG. 7 in accordance with another embodiment of the present disclosure.

FIG. 8 is a cross-sectional view showing a part of a throwing device 1 shown in FIG. 7 in accordance with another embodiment of the present disclosure. The first section 110 of the propulsion system comprises a first chamber 110 containing a first propellant 114*a*, 114*b*, and an igniter 118 for igniting the first propellant 114*a*, 114*b*. Optionally, the igniter 118 may be an explosive primer. Wherein the launcher 20 further comprises ignition coils 240 powered by a power source 250 controlled by the trigger 210 to ignite the igniter 118, wherein the ignition coils 240 extends into the first section 110 of the propulsion system through the nozzle 140, and produce spark to ignite the explosive primer of the igniter 118.

Although the present disclosure and its advantages have been described in detail, it should be understood that various changes, substitutions and alterations can be made herein without departing from the spirit and scope of the disclosure as defined by the appended claims. For example, many of the processes discussed above can be implemented in different methodologies and replaced by other processes, or a combination thereof.

Moreover, the scope of the present application is not intended to be limited to the particular embodiments of the process, machine, manufacture, composition of matter, means, methods and steps described in the specification. As one of ordinary skill in the art will readily appreciate from the disclosure of the present disclosure, processes, machines, manufacture, compositions of matter, means, methods, or steps, presently existing or later to be developed, that perform substantially the same function or achieve substantially the same result as the corresponding embodiments described herein may be utilized according to the present disclosure. Accordingly, the appended claims are intended to include within their scope such processes, machines, manufacture, compositions of matter, means, methods, or steps.

What is claimed is:

1. A propulsion system, comprising:

a first section including a first chamber containing a first propellant;

a second section connected to the first section, the second section including a second chamber containing a second propellant; and a retardant set between the first propellant and the second propellant for delaying combustion from the first propellant to the second propellant, the retardant set including a dish with holes in a bottom, the dish containing a third propellant, the dish and the third propellant being covered by a mesh.

2. The propulsion system of claim 1, wherein the third propellant has a low regression rate.

3. The propulsion system of claim 1, wherein the third propellant includes Sorbitol, Potassium Nitrate, and Iron Oxide.

4. The propulsion system of claim 2, wherein the third propellant includes Sorbitol, Potassium Nitrate, and Sodium Bicarbonate.

5. The propulsion system of claim 4, wherein a ratio of the Sodium Bicarbonate to the Sorbitol and the Potassium Nitrate in the third propellant is about 15 to 100 in weight.

6. The propulsion system of claim 4, wherein a ratio of the Sorbitol to the Potassium Nitrate in the third propellant is about 35 to 65 in weight.

7. A propulsion system, comprising:

a first section including a first chamber containing a first propellant;

a second section connected to the first section, the second section including a second chamber containing a second propellant; and a retardant set between the first propellant and the second propellant for delaying combustion from the first propellant to the second propellant, wherein the retardant set includes a third propellant and a dish with holes in a bottom for containing the third propellant, the third propellant including Sorbitol, Potassium Nitrate, and Sodium Bicarbonate, and wherein the dish and the third propellant are covered by a mesh.

8. The propulsion system of claim 7, wherein the retardant set faces the first propellant through the mesh, and the retardant set faces the second propellant through the dish.

9. The propulsion system of claim 1, wherein the first section comprises an igniter, and the first propellant includes one or more combustion channels.

10. The propulsion system of claim 1, wherein the second propellant includes one or more combustion channels.

11. The propulsion system of claim 1, wherein the first chamber includes an open top and a bottom with holes.

12. The propulsion system of claim 11, wherein the second chamber includes a bottom with holes, and the second chamber is connected to the open top of the first chamber by the bottom of the second chamber.

13. The propulsion system of claim 12, wherein the retardant set is installed on the bottom of the second chamber.

14. The propulsion system of claim 13, wherein a thickness of a space for containing the retardant set is about 1 cm.

15. The propulsion system of claim 1, wherein an exposed surface of the first propellant is more than an exposed surface of the second propellant.

16. The propulsion system of claim 1, further comprising a nozzle in a bottom of the first section.

17. The propulsion system of claim 16, further comprising a space between the nozzle and the first propellant.

18. The propulsion system of claim 1, further comprising a warhead over the second section.

19. The propulsion system of claim 1, wherein the first propellant includes Sorbitol, Potassium Nitrate, and Iron Oxide, and the second propellant includes Sorbitol, Potassium Nitrate, and Iron Oxide.

20. The propulsion system of claim 1, wherein each of the first propellant and the second propellant includes Sorbitol and Potassium Nitrate, and wherein a ratio of the Sorbitol to the Potassium Nitrate in each of the first propellant and the second propellant is about 35 to 65 in weight.

* * * * *